US005957826A

United States Patent [19]

Bohn et al.

[11] Patent Number: 5,957,826

[45] Date of Patent: Sep. 28, 1999

[54] MACHINING TOOL, PARTICULARLY A TRANSVERSE STAMPING TOOL FOR LAYER MATERIAL

[75] Inventors: Martin Bohn, Reutlingen; Wolfgang Scheller, Oberpleichfeld, both of Germany

[73] Assignee: bielomatik Leuze GmbH & Co., Germany

[21] Appl. No.: 08/425,412

[22] Filed: Apr. 20, 1995

[30] Foreign Application Priority Data

Apr. 30, 1994 [DE] Germany ..... 44 15 291

[51] Int. Cl.[6] ..... B31B 1/14

[52] U.S. Cl. ..... 493/354; 493/468; 83/346

[58] Field of Search ..... 83/103, 346, 348; 493/354, 396, 468

[56] References Cited

U.S. PATENT DOCUMENTS

| | | | |
|---|---|---|---|
| 2,485,020 | 10/1949 | Staude | 493/354 |
| 2,810,329 | 10/1957 | Schmidt | 493/354 |
| 3,314,340 | 4/1967 | Bishop | 493/354 |
| 3,383,991 | 5/1968 | Sarka | 493/354 |
| 3,744,384 | 7/1973 | Jarritt | 493/354 |
| 3,952,637 | 4/1976 | Lambert | 493/354 |
| 4,020,724 | 5/1977 | Quinlan . | |
| 4,799,414 | 1/1989 | Scheffer et al. . | |
| 4,931,031 | 6/1990 | Lisiecki | 493/354 |
| 4,962,683 | 10/1990 | Scheffer | 83/103 |
| 5,088,367 | 2/1992 | Cracchiolo et al. . | |
| 5,221,249 | 6/1993 | Simpson . | |
| 5,253,561 | 10/1993 | Wynn | 83/346 |
| 5,429,577 | 7/1995 | Simpson | 493/354 |
| 5,555,786 | 9/1996 | Fuller | 83/346 |

FOREIGN PATENT DOCUMENTS

| | | |
|---|---|---|
| 318174 | 5/1989 | European Pat. Off. . |
| 04 98 623 | 8/1992 | European Pat. Off. . |
| 114169 | 8/1994 | European Pat. Off. . |
| 28 52 521 | 6/1979 | Germany . |
| 86 27 500 | 10/1986 | Germany . |
| 6 80 845 | 11/1992 | Switzerland . |
| 8 68 393 | 5/1961 | United Kingdom . |

*Primary Examiner*—Kurt Rowan
*Attorney, Agent, or Firm*—Quarles & Brady

[57] ABSTRACT

In a transverse grooving tool the groove webs are continuously adjustable with respect to the body in the running direction and can be fixed in any set position and for this purpose sliding guides and clamping means are provided. Adjacent to at least one adjustable working member can also be provided a non-adjustable working member, e.g. a further grooving tool and/or a balancing weight. As the working members are also interchangeable, there are numerous possibilities for reequipping the tool.

21 Claims, 1 Drawing Sheet

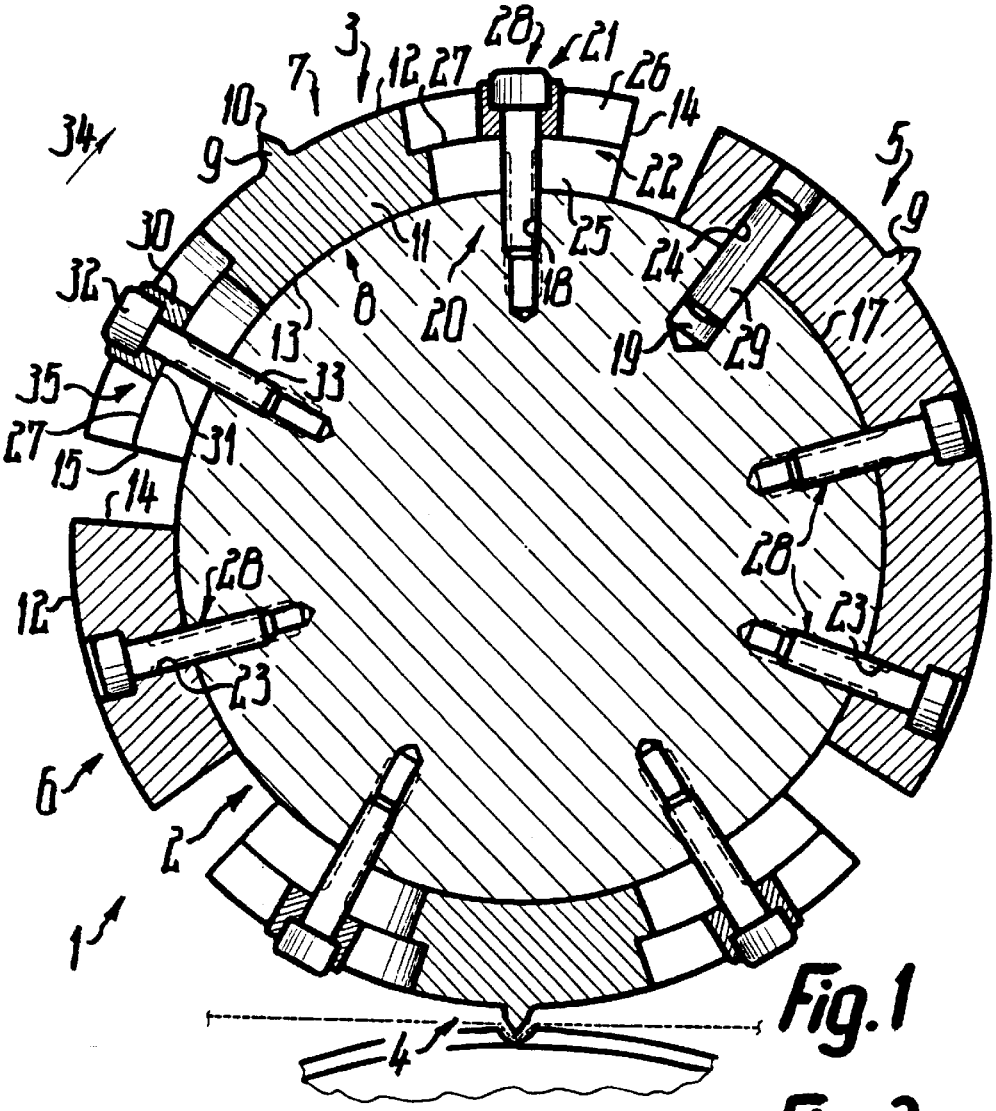
Fig.1
Fig.2
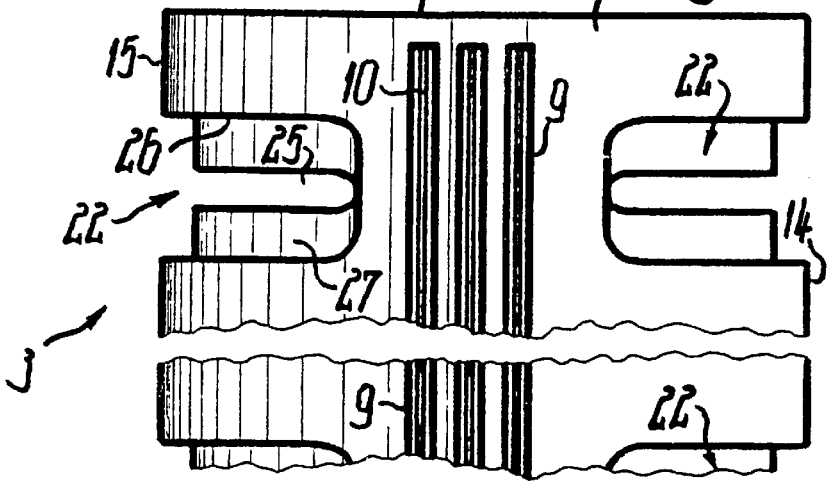

MACHINING TOOL, PARTICULARLY A TRANSVERSE STAMPING TOOL FOR LAYER MATERIAL

BACKGROUND OF THE INVENTION

The present invention relates to a machining tool, such as is in particular used for the machining or working of paper-like materials in machines, through which the material is moved continuously and is simultaneously machined by the tool by reciprocal movement at one or more points, which can be parallel to the working or running plane of the material in and/oblique or transverse to the running direction so as to be spaced from one another.

Such machining operations are in particular linear, modify or reduce or compress the cross-section of the material and can be perforations, holes, impressions, etc., but in particular grooves, which are e.g. used as folding joints for folding of the material following groove formation. The tool may perform identical or different types of the aforementioned or other machinings.

The machining tool, which can be constructed as a continuously rotating tool or the like, appropriately has a body for the movable or driven mounting in a machine frame and on the latter has one or more working members, which are in the working state and move in the running direction and/or transversely thereto in spaced manner. At least one working member can be constructed as a tool member and can have one or more working surfaces distributed in the aforementioned manner for direct engagement in the material or at least one working member can be completely free from such working surfaces or not provided for direct engagement in the material and can merely serve to fill a gap on the working side of the tool, as a balancing weight or the like.

OBJECTS OF THE INVENTION

An object of the invention is to provide a machining tool, which avoids the disadvantages of known constructions or can offer advantages compared with known constructions and which in particular permits a simple conversion for different machining operations, so that the same body can be used for very different machining operations.

SUMMARY OF THE INVENTION

According to the invention at least one working member is formed by a component separate from the body and after its manufacture and/or that of the body can be fixed to the latter and/or is positionally variable in stages and/or continuously with respect to the body or at least one further working member and appropriately there is a non-destructive release and fixing of the working member.

Therefore the particular working member can be releasable or replaceable transversely to the working plane and/or adjustable or convertible parallel to the working plane in at least one direction, so that it can be brought into a different working position with respect to the body for the particular machining operation. For example, the working member can be continuously transferable or adjustable transversely to and/or in the running direction, the path of the position change being appropriately larger than the extension of the working surface or a working projection parallel thereto. In the particular working position the working member is to be fixed with respect to the body in clearance-free or positionally fixed manner, so that e.g. by bracing it absorbs a significant part of the bending and/or torsional forces acting on the machining tool.

If all the working members are formed by components separate from the body, then the latter can have for the working members a bearing surface continuing over the extension thereof in and/or transversely to the running direction in such a way that each working member at each point of said bearing surface can be supported in substantially identically satisfactory manner in large-area form. The substantially cylindrical bearing surface over its length and circumference can be traversed by centring and/or clamping openings, which are appropriately formed by blind holes, such as centring holes with a smooth circumference, tapped holes, etc. In the core, centre or in all areas outside the roughly radial openings the body can have solid cross-sections. Appropriately a plurality of identical and/or different openings can be provided in a common axial plane at right angles to the rotation axis or distributed in approximately uniform manner in a ring around the rotation axis, so that the body, without additional balancing weight can be statically and dynamically at least approximately balanced.

For adjustment purposes the working member is appropriately provided with a pretensioned or clearance-free, pretensionable sliding guide, whose interengaging sliding faces do not engage in countersunk manner in the bearing surface of the body and instead are inwardly displaced in said bearing surface and/or spaced outside said bearing surface, but appropriately facing the largest outer face of the working member remote from the body. These sliding faces can simultaneously form the sole clamping faces for fixing the working member.

In a view of the working side of the working member the associated locking, guiding, fixing, positioning, adjusting and/or centring means are completely within the peripheral outer contour of the working member and with respect to the working side project less far than any working faces and are engaged in or traverse in partly embedded manner the outer face of the working member.

If the said means have bolts such as cap screws with threaded shanks and bolt heads widened with respect to the latter or centring pins displaceable in stop-free manner in holes, then the particular working member can be continuously moved over the entire circumference and the length of the body, if the particular bolt is disengaged from the body or the working member. If a bolt is rotatably mounted, its ring shoulder-like supporting face e.g. formed by the head and accompanied by the interposing of an intermediate or spacing member engages in the counterface, the supporting surface being slidingly rotatable with respect to the intermediate member, so that a rotary movement of the bolt does not lead to a rotary movement of the intermediate member with respect to the counterface. This makes it possible to avoid that the working member is adjusted relative to the body or bolt rotation. In addition, the sliding friction between the working member and the body can be randomly continuously adjusted, so that a very sensitive adjustment of the working member is possible by compression stressing on an outer face freely accessible from the outside. The control or positioning means are appropriately so provided that they can only be operated when the tool is stationary, but said position changes can also be performed when the tool is in the working position in the machine bearing and when the tool is disassembled from the machine bearing or separate from the latter.

In a simple embodiment the working member is provided in shell segmental manner with through holes, which are substantially uniformly distributed longitudinally and/or circumferentially. Such through holes can be open to the full width towards the adjacent outer longitudinal edge of the working member positioned transversely to the running direction, so that the clamping bolts or intermediate members can be inserted radially with respect to the axis thereof, also from said outer edges. However, in a view on the working side the openings are appropriately spaced in the running direction from the working face or faces of the working member, so that the latter or its supporting face can be completely free from openings in the vicinity of the working face. Appropriately two facing working members are mounted in adjustable manner, whereas two further working members are non-adjustable, but interchangeably fixed displaced with respect to the two adjustable working members or located in gaps between them. One of the non-adjustable working members can have in the running direction the smallest extension or can be present as a balancing weight or the like and the remaining working members can in each case have at least one working face. This leads to numerous adjustment possibilities for all the working or tool members with respect to one another.

When the tools are long transversely to the running direction it is advantageous to divide the particular working member over the working width or to provide in this direction two or more interconnecting working members, whose working faces can then operate in substantially uninterrupted manner like a continuous working face or separately in two useful widths. Therefore the working members can be more simply manufactured, fitted and replaced and if one working member is damaged, it does not have to be replaced over the entire working width. As desired, all the working members can have each of the said features in the same or different combination, as well as being substantially identical in cross-section transversely and/or parallel to the running direction. In each of these directions two to all the working members can have a constant, continuous or identical thickness.

BRIEF FIGURE DESCRIPTION

These and further features can be gathered from the claims, description and drawings and the individual features, both singly and in the form of random subcombinations, can be implemented in an embodiment of the invention and in other fields and can represent advantageous, independently protectable constructions for which protection is hereby claimed.

Embodiments of the invention are described in greater detail hereinafter by way of the drawings, wherein show:

FIG. 1 a machining tool according to the invention in cross-section, and

FIG. 2 a detail of another embodiment of a working member in a view of the working side.

DETAILED DESCRIPTION OF PREFERRED EXAMPLE EMBODIMENTS

The tool 1 according to FIG. 1 is used for the continuous machining over a working width or more than 350 or 500 mm, particular approximately 680 mm and is constructed as a transverse grooving cylinder, which stamps linear grooves solely at right angles to the running direction of the material and to its equidirectional running direction, namely during each rotation a plurality of spaced succeeding, parallel and identical transverse grooves are stamped. The tool does not perform other machining operations.

The tool 1 has as its core a roller-like, cylindrical body, on whose ends are provided in freely projecting manner journals reduced compared with its core diameter and which for mounting in plates of a machine frame can project on either side of the working width. Distributed over the circumference of the body 2 there are four working members 3 to 6, two identical members being adjustably mounted on the body 2. A further working member 5 is fixed non-adjustably to the body 2 between the adjustable working members 3, 4, has roughly the same circumferential extension as the latter and like the latter is constructed as a tool member. A fourth working member 6 faces the working member 4, also between the working members 3, 4 and has circumferentially the smallest extension and is also non-adjustable, but is fixed in replaceable manner. All the working members extend roughly over the same longitudinal extension of the body 2 or are of the same length and between all adjacent working members can be provided a gap, bounded at the bottom from the body 2 and whose circumferential extension is smaller than that of the working members 3 to 6 or is positioned about the rotation axis by about 5 to 20° or approximately 10°.

The outer circumferential sides of the working members 4 to 6 remote from the body 2 form the working side 7 of the tool 1, whereas the sides facing the body 2 and remote therefrom form the backs 8 of the working members 3 to 6. The machining tool members 3 to 5 have in each case a web-like working projection 9 projecting to the working side 7 and located in an axial plane of the tool axis and whose outermost narrow edge forms the working face 10, which passes approximately continuously over the entire length of the associated tool member 3 to 5 and circumferentially has a width of max approximately 1 mm. All the working faces 10 are in a common envelope cylinder, whose axis coincides with the rotation axis.

Each working member 3 to 6 has a shell segmental supporting body 11, which is cross-sectionally at right angles to the rotation direction and which in the circumferential direction projects to either side by a multiple of the width of the working face 10 over the associated working head 9 and connected on either side to the associated working head 9 has up to the outer edge remote therefrom and over its entire length a constant thickness. The outer faces 12 and supporting surfaces 13 of the supporting body 11 are, with the exception of the vicinity of the working projection 9, curved in a continuously convex or concave manner about the rotation axis, the outer faces 12 on the one hand and the supporting surfaces 13 on the other of all the working members 3 to 6 having the same radii of curvature or spacings from the rotation axis.

Circumferentially the particular supporting member 11 is bounded by a front and rear running edge 14, 15, which is located at right angles to the running direction in an axial plane of the rotation axis and up to which roughly extends the associated outer or supporting surface 12, 13. These edge faces 14, 15 form the flanks of the intermediate gaps. On its ends associated with the working width the particular supporting body 11 is bounded by terminal edges 16, which pass roughly flat between the surfaces 12, 13 and are located in a plane at right angles to the rotation of central axis. All the associated edge faces 16 of the supporting body 11 are located in a common plane. The working face 10 is formed in one piece by the associated working projection 9, which in turn is constructed in one piece with the associated supporting body 11, so that the one-piece working member 3 to 5 is formed. The working member 6 serving as the sole balancing weight does not have a projection and is also constructed in one piece. For the complete support extending up to the edge faces 14 to 16 and also located in the axial plane of the associated working face 10 of the part cylindrical supporting surface 13 of the particular working member 3 to 6 and which is free from projections the outermost circumference of the body 2 forms a cylindrical bearing surface 17, which extends over the entire length of the working members 3 to 6. This bearing surface 17 is only traversed or interrupted by holes 18, 19, which are provided exclusively in juxtaposed manner in the common axial planes of the rotation axis and successively in the axial planes at right angles thereto and in plurality form. For each working member there are appropriately three longitudinally directed, adjacent holes 18, 19, whereof two have a spacing from the associated terminal edge 16 roughly corresponding to their greatest width and one is located in the centre between them. In the circumferential direction for the working members 3, 4 there are two adjacent holes 18 and for the working member 5 three adjacent holes 18, 19, whereas for the working member 6 there is only one longitudinal row of holes 18. All the holes 18 are constructed as tapped blind holes, which have the same length, same internal diameter and/or same thread lead. The holes 19 are thread-free and smooth-surfaced. Over the bearing surface 17 constructed as a sliding surface project outwards no projections of the one-piece core of the body 2.

The holes 18, 19 at right angles to the rotation axis belong to the locking means 20 or controlling and guiding means 21 and can be made to coincide with the openings 22 to 24 of the particular working member 3 to 6. The openings 22 of the working members 3, 4 are circumferentially elongated in slot-like manner and have a stepped width in the longitudinal direction of the tool, so that in each case they form a narrower, inner opening part 25 connected to the supporting surface 13 and a widened outer opening part 26 of roughly the same depth connected to the outer face 12. The opening parts 25, 26 pass via two facing countersunk shoulders 27 connected to one another at one end of the opening 22 into one another and are curved about the rotation axis and in the circumferential direction assume an arc angle between approximately 15 and 35°, particularly 25°. The width of the opening parts 25, 26 is roughly constant over the entire opening length and up to the associated edge face 14, 15. The ends of the openings 22 remote from the open opening ends on the edge faces 14, 15 and closer to the associated working projection 9 are spaced from the latter and have a spacing roughly corresponding to the opening length. The part cylindrical shoulders 27 of all the working members 3, 4 are in a common cylindrical envelope equiaxial to the rotation axis. On both sides and at the inner end of the opening part 25 in directly connecting manner the supporting surface 13 is supported on the bearing surface 17.

The working member 5 has on one side of its working projection 9 two circumferentially spaced rows of axially symmetrical through holes 23, which act in a centring manner in all directions transverse to their hole axis. Circumferentially on the other side of the working projection 9 there is only one longitudinal row of through holes 24 having a corresponding action and construction. Roughly in the centre between its running edges the working member 6 only has one longitudinal row of holes 23. Following onto the associated outer faces 12 the holes 23 have widened end portions, whereas the hole 24 passes through constantly between the associated outer face 12 and the supporting surface 13.

The openings 22 to 24 serve to receive locking members 28, 29, the locking members for the openings 22, 23 and the associated holes 18 being formed by screw bolts, whereas the locking members for the openings 24 and the associated holes 19 are formed by thread-free and therefore axially displaceable centring pins. These pins are seated more firmly in a hole 24 than in the other hole 19 in which they are easily displaceable. The opening parts 26 are provided for receiving in each case a single, one-piece intermediate member 30, which is in turn supported on the associated locking member 28 and on the associated shoulders 27 on either side of the locking member 28. The sleeve-like intermediate member 30 circumferentially enclosing the locking member 28 has a part cylindrical, curved end face 31 around the axis of curvature of the shoulder 27 with which it engages in full-surface, slidable and twist-prevented manner on the two shoulders 27.

The width of the opening part 25, with slight transverse clearance, is adapted to the width of the shank 33 of the locking member 28, whereas the width of the opening part 26, with a corresponding movement clearance, is adapted to the external width of the cylindrical outer face of the intermediate member 30 and is therefore much wider than the head 32 of the locking member 28. The intermediate member 30 is located exclusively in the opening part 26 and can, like the head 32, project slightly over the outer face 12, the head 32 appropriately projecting slightly less far and has in its outer end face an engagement member for engaging positively with respect to rotational movement of a manually operable tool. The shanks 33 or heads 32 of all the locking members 28 can have the same length, external width or diameter and/or thread lead, so that only identical screws 28 are required and are all reciprocally interchangeable. Correspondingly all the pins 29 have the same construction. The arc spacing of the holes 18 associated with the working member 3 or 4 corresponds to the average arc spacing of the associated holes 22, so that if the surface 31 of a locking member 28 is immediately adjacent to the associated edge 14 or 15, the surface 31 of the locking member adjacent to the other edge 15 or 14 assumes the greatest distance from said edge or is connected approximately to the inner end of the associated opening 22, but the working member cannot be removed from the body.

In the case of slightly loosened locking members 28 as a result of the described construction for each of the two working members 3, 4 a sliding guide 35 is formed between two facing, concentrically curved or parallel sliding faces 17, 31, which prevent radial clearance movements of the working member 3, 4 transversely to the sliding faces, but allows positioning movements exclusively in and counter to the running direction 34 of the tool 1 by a manual shifting of the working member 3, 4 with respect to the body 2 and without a servodrive. Slight clearance or tolerance movements are also possible in the longitudinal direction. Both or all the adjustable working members 3, 4 are adjustable independently of one another and independently of all the remaining working members 5, 6.

The tool 1 or its working faces 10 cooperate with the circumference of a countertool, which is rotatable about an axis parallel to the tool 1 and with the latter forms a width-adjustable passage gap for the material. The width is in particular adjustable by the radial setting of the countertool. At the narrowest point of the passage gap the material is jammed between the working surface 10 and the optionally pressure-elastic, resilient countercircumference and simultaneously the working surface 10 stamps the groove in such a way that it represents a non-reversible machining or deformation. The countercircumference is uniformly cylindrical and smooth, so that the working projection 9 can engage with the same effect in any random circumferential area and no counter-grooves are required for the engagement of the working surfaces 10. The countertool and the tool 1 are so drive-connected with one another, e.g. by means of a single-stage belt drive, that for protection purposes each working surface 10 during each following rotation strikes a different circumferential point of the countertool to that during the preceding rotation. The countercircumference can be formed by an elastomer coating of the uninterrupted, smooth, cylindrical, as well as dimensionally stable, non-resilient circumference of a roller core made from steel or the like and can have an approximate Shore hardness of 40 to 80. The through-constant thickness of the coating is appropriately approximately 10 mm. The construction and arrangement of the countertool can also be independent of all the other constructions.

Following the adjustment of the particular working member 3, 4, the latter is braced by fixing the associated locking members 28, so that then the surfaces 13, 17 on the one hand and 27, 31 on the other form interengaging clamping faces and are in themselves sufficient for locking the position of the working member 3, 4. The outer face 12 of the working member 6 can be used for guiding the material. If the locking bolts 28 screwed into the holes 18, optionally including the intermediate members 30 are unscrewed and completely separated from the body 2, then the associated working member 3, 6 can be removed as a whole and optionally including the locking members 28, 30 from the said body 2. The heads 32 of the locking members 28 of the working members 5, 6 are completely embedded in the outer faces 12 thereof.

According to FIG. 2 the working member 3*a* can have between the rows of openings 22 two or more immediately adjacent and parallel working projections 9. The end of the projection 9 is appropriately slightly set back with respect to the associated terminal edge 16. The working members 3, 4 can be adjusted to such an extent in both directions that in each case one of their running edges 14, 15 strikes against the opposite running edge 15, 14 of the adjacent working member 5, 6 and between said running edges there is no longer any gap, whereas the gap on the running edge removed therefrom is correspondingly enlarged.

We claim:

1. A tool for machining layer material, comprising:

a rotary tool body defining a roller axis and including an arcuate roller circumference coaxial with said roller axis;

at least one machining member provided for operationally engaging the material, said at least one machining member including a shell segmental supporting body having a working side face and a backside remote from said working side face, said working side face extending laterally and radially offset with respect to at least one working face for operationally deforming the layer material, said backside including an arcuate clamping face coaxial with said roller axis;

clamping means for radially clamping said clamping face against said roller circumference, said clamping means including radial clamping bolts and reception openings radially traversing said supporting body apart from said at least one working face, said clamping bolts traversing said reception openings bounded by said supporting body, said supporting body including first and second circumferential member ends, wherein together with said at least one working face, said at least one machining member is positionally continuously adjustable and lockable with respect to said rotary tool body, said reception openings traversing at least one of said first and second member ends for circumferentially separating said at least one machining member from said clamping bolts;

with respect to said rotary tool body said at least one machining member is lockable with at least two separately openable locking members spaced from one another in directions parallel, and transverse to said roller axis and said at least one working face, said at least one machining member providing a section of said supporting body, said at least one machining member and said supporting body being commonly displaceable and lockable with respect to said rotary tool body, in plan view on said at least one working face said supporting body defining an outermost peripheral edge boundary, said locking members and said at least one working face being located substantially entirely within said edge boundary; and, spaced between said at least one working side face and said clamping face said supporting body including a locking shoulder coaxial with said roller axis and directly connecting to said outermost peripheral edge boundary.

2. The tool according to claim 1, wherein said tool is provided for operationally performing a machining motion defining a motion direction, at least one of said machining member being adjustable substantially parallel to said motion direction with respect to said at least one tool body, at least one of said working face being oblong and substantially linear transverse to said motion direction.

3. The tool according to claim 3, wherein transverse to a longitudinal orientation of said tool at least one of said machining member is substantially continuously adjustable and lockable with interengaging locking surfaces provided in at least one transition zone between said at least one tool body and said at least one machining member.

4. The tool according to claim 3, wherein in cross-section parallel to said motion direction at least one of said working face defines an overall engaging extension for deformingly engaging the material, at least one of said machining member being adjustable over an at least twenty times extension compared with said overall engaging extension.

5. The tool according to claim 1, wherein at least one of said machining member provides a common unit with a supporting body, in plan view on said at least one working face said supporting body extending substantially farther than said at least one working face.

6. The tool according to claim 1, wherein said at least one of said machining member is adjustably mounted with at least one sliding guide adjustable to reduce motion play oriented transverse to said back side to substantially zero, said sliding guide having only one single degree of freedom for displacing said at least one machining member with respect to said at least one tool body, adjusting means being provided for adjusting said motion play and a sliding friction of said at least one sliding guide, said at least one sliding guide including interengaging sliding faces on said at least one tool body and said at least one machining member, at least one of said sliding faces being arcuated around a center axis by a radius larger than a thickness extension of at least one of said machining member, said center axis being oriented substantially parallel to a longitudinal extension of at least one of said working face, in plan view said working face being smaller than said sliding faces of said at least one machining member.

7. The tool according to claim 1, further comprising adjusting means for adjusting and locking said at least one machining member, said adjusting means having an elongated oblong guide opening oriented transverse to said at least one working face, in plan view on said at least one working face said at least one machining member having a peripheral boundary edge, said guide opening having an opening end issuing in said boundary edge.

8. The tool according to claim 1, further comprising a counter tool cooperating with said tool to machine the layer material, said counter tool providing a counter-circumference for periodically engaging said at least one working face, in operation said at least one working face defining an orbital rotary velocity and said counter-circumference defining a rotary circumferential velocity differing from said orbital rotary velocity at least while said at least one working face engages said counter-circumference with the layer material interposed between said at least one working face and said counter-circumference.

9. The tool according to claim 1, wherein:

said at least one machining member comprises first and second opposing machining members defining a circumferential interspacing and having respective working faces, at least one of said respective working faces being linearly longitudinally oblong and substantially continuously extending over a machining width extension of said rotary tool body, said interspacing being continuously variable; and, a third machining member is located within said circumferential interspacing and radially directly clamped against said roller circumference, said third machining member being removable from said roller circumference but not continuously circumferentially adjustable, said third machining member also having a respective working face, said first and second machining members being individually and separately circumferentially adjustable.

10. The tool according to claim 1, wherein in cross-section said at least one machining member comprises an outermost web projecting freely away from said working side face and forming said at least one working face, both said working side face and said clamping face being coaxial with said roller axis, said web and said working face being made in one part, with said clamping face directly engaging said roller circumference, said reception openings traversing both said first and second member ends.

11. The tool according to claim 1, wherein said at least one machining member comprises a stamping tool, in cross-section said at least one machining member decreasing towards said at least one working face and being provided for at least partially penetrating the material without separating and severing the material, said at least one working face defining a longitudinal median plane oriented substantially parallel to said roller axis and defining remote plane sides, said clamping bolts engaging said supporting body on both said plane sides while circumferentially adjusting said at least one machining member.

12. The tool according to claim 1, wherein said clamping means rigidly lock said at least one machining member with respect to said rotary tool body without motion play, said clamping means clamping said at least one machining member exclusively with said clamping face against said roller circumference, said working side face being coaxial with said roller axis, said clamping bolts being countersunk within said at least one machining member.

13. The tool according to claim 1, wherein said tool is operationally rotatable in a motion direction, a plurality of separate machining members being circumferentially juxtaposed, at least first and second ones of said plurality of machining members being separately adjustable, reciprocally exchangeable, and located on remote sides of at least one non-adjustable but removable intermediate machining member made in one part, said intermediate machining member being circumferentially entirely spaced from said first and second ones of said machining members.

14. The tool according to claim 1, further comprising a balancing member for at least partly mass balancing said tool, said balancing member being free from working faces and supported directly on said roller circumference, said balancing member being entirely spaced from said at least one machining member and including a face continuation of said working side face, said face continuation being coaxial with said roller axis.

15. The tool according to claim 1, further comprising a counter tool for cooperating with said tool to machine the layer material, said counter tool having a counter-circumference for periodically engaging said working face with limited areas of said counter-circumference and with an operating pressure, in said limited areas said counter-circumference being free of depressions and circular in cross-section, under said operating pressure said counter-circumference giving way resiliently and elastically only in an area substantially limited to an overall superficial extension of said at least one working face.

16. The tool according to claim 1, wherein said at least one working face is oblong parallel to said roller axis, said at least one working face being subdivided into at least first and second chaining length sections oriented in a common line, each one of said first and second chaining length sections being provided on respective machining members, said respective machining members being separately and independently adjustable and lockable with respect to said rotary tool body, said rotary tool body being provided for receiving both said respective machining members in positions juxtaposed parallel to said chaining length sections.

17. A tool for machining layer material, comprising:

a rotary tool body defining a roller axis and including an arcuate roller circumference coaxial with said roller axis;

at least one machining member provided for operationally engaging the material, said at least one machining member including a shell segmental supporting body having a working side face and a backside remote from said working side face, said working side face extending laterally and radially offset with respect to at least one working face for operationally deforming the layer material, said backside including an arcuate clamping face coaxial with said roller axis;

clamping means for radially clamping said clamping face against said roller circumference, said clamping means including radial clamping bolts and reception openings radially traversing said supporting body apart from said at least one working face, said clamping bolts traversing said reception openings bounded by said supporting body, said supporting body including first and second circumferential member ends, wherein together with said at least one working face, said at least one machining member is positionally continuously adjustable and lockable with respect to said rotary tool body, said reception openings traversing at least one of said first and second member ends for circumferentially separating said at least one machining member from said clamping bolts; and, said clamping means positionally lock said machining member with respect to said rotary tool body, said clamping means exclusively including first and second pluralities of said clamping bolts and of centering openings for receiving said clamping bolts, said clamping bolts radially traversing said at least one machining member from said at least one working side face beyond said clamping face and being accessible at said working side face for locking and loosening said at least one machining member, said at least one working face being oblong and oriented substantially parallel to said roller axis, on remote length sides of said at least one working face said at least one machining member defining first and second member edge faces, said first plurality of centering openings traversing said first member edge face and said second plurality of centering openings traversing said second member edge face.

18. A tool for machining layer material, comprising:

a rotary tool body defining a roller axis and including an arcuate roller circumference coaxial with said roller axis;

at least one machining member provided for operationally engaging the material, said at least one machining member including a shell segmental supporting body having a working side face and a backside remote from said working side face, said working side face extending laterally and radially offset with respect to at least one working face for operationally deforming the layer material, said backside including an arcuate clamping face coaxial with said roller axis;

clamping means for radially clamping said clamping face against said roller circumference, said clamping means including radial clamping bolts and reception openings radially traversing said supporting body apart from said at least one working face, said clamping bolts traversing said reception openings bounded by said supporting body, said supporting body including first and second circumferential member ends, wherein together with said at least one working face, said at least one machining member is positionally continuously adjustable and lockable with respect to said rotary tool body, said reception openings traversing at least one of said first and second member ends for circumferentially separating said at least one machining member from said clamping bolts; and, said clamping means has locking faces located between said clamping face and said working side face, said locking faces providing oblong sliding faces for positionally adjusting said at least one machining member, said sliding faces bounding a slot traversing said at least one machining member transverse to said working side face and having at least one stepped side wall to provide an adjusting and locking guide directly connecting to an outermost edge boundary of said at least one machining member.

19. A tool for machining layer material, comprising:

a rotary tool body defining a roller axis and including an arcuate roller circumference coaxial with said roller axis;

at least one machining member provided for operationally engaging the material, said at least one machining member including a shell segmental supporting body having a working side face and a backside remote from said working side face, said working side face extending laterally and radially offset with respect to at least one working face for operationally deforming the layer material, said backside including an arcuate clamping face coaxial with said roller axis;

clamping means for radially clamping said clamping face against said roller circumference, said clamping means including radial clamping bolts and reception openings radially traversing said supporting body apart from said at least one working face, said clamping bolts traversing said reception openings bounded by said supporting body, said supporting body including first and second circumferential member ends, wherein together with said at least one working face, said at least one machining member is positionally continuously adjustable and lockable with respect to said rotary tool body, said reception openings traversing at least one of said first and second member ends for circumferentially separating said at least one machining member from said clamping bolts; and said clamping means has separate locking keys traversed by said clamping bolts, said separate locking keys directly supporting against said at least one machining member and said clamping bolts directly engaging under tension threads of said rotary tool body, in a loosened state said locking keys slidingly engaging said at least one machining member for adjusting said at least one machining member with respect to said locking keys, said rotary tool body and said clamping bolts in a circumferential direction, said separate locking keys being components separate from said at least one machining member and said locking bolts, means being provided for disengaging said locking keys from said at least one machining member by displacing said at least one machining member with respect to said locking keys, said locking bolts and said rotary tool body in said circumferential direction.

20. A tool for machining layer material, comprising:

a rotary tool body defining a roller axis and including an arcuate roller circumference coaxial with said roller axis;

at least one machining member provided for operationally engaging the material, said at least one machining member including a shell segmental supporting body having a working side face and a backside remote from said working side face, said working side face extending laterally and radially offset with respect to at least one working face for operationally deforming the layer material, said backside including an arcuate clamping face coaxial with said roller axis;

clamping means for radially clamping said clamping face against said roller circumference, said clamping means including radial clamping bolts and reception openings radially traversing said supporting body apart from said at least one working face, said clamping bolts traversing said reception openings bounded by said supporting body, said supporting body including first and second circumferential member ends, wherein together with said at least one working face, said at least one machining member is positionally continuously adjustable and lockable with respect to said rotary tool body, said reception openings traversing at least one of said first and second member ends for circumferentially separating said at least one machining member from said clamping bolts;

said clamping means has adjusting means for adjusting said at least one machining member, said clamping means being operable without an adjusting gear;

said rotary tool body having an adjusting slot therein, said clamping and adjusting means including at least one tensioning reception provided in said roller circumference directly supporting said at least one machining member on said clamping face, in operation said at least one machining member unresiliently rigidly holding said at least one working face with respect to said rotary tool body; and, said clamping face and said at least one working face being made in one part, in plan view said at least one working face being entirely located between locking faces traversed by said locking bolts.

21. A tool for machining layer material, comprising:

a rotary tool body defining a roller axis and including an arcuate roller circumference coaxial with said roller axis;

at least one machining member provided for operationally engaging the material, said at least one machining member including a shell segmental supporting body having a working side face and a backside remote from said working side face, said working side face extending laterally and radially offset with respect to at least one working face for operationally deforming the layer material, said backside including an arcuate clamping face coaxial with said roller axis;

clamping means for radially clamping said clamping face against said roller circumference, said clamping means including radial clamping bolts and reception openings radially traversing said supporting body apart from said at least one working face, said clamping bolts traversing said reception openings bounded by said supporting body, said supporting body including first and second circumferential member ends, wherein together with said at least one working face, said at least one machining member is positionally continuously adjustable and lockable with respect to said rotary tool body, said reception openings traversing at least one of said first and second member ends for circumferentially separating said at least one machining member from said clamping bolts; and, said at least one machining member is constructed as a shell segment extending over an arc angle of less than 180° and at least 25° to 35°, said shell segment being radially assembleable on said rotary tool body, said rotary tool body in the vicinity of said at least one machining member being a one part cylinder body externally including said roller circumference for supportingly receiving said at least one machining member in any position entirely around said roller circumference, for locking and centering said at least one machining member said roller circumference exclusively being provided with bores oriented substantially radially with respect to said roller circumference, radially inside said working side face said supporting body including an arcuate oblong locking face equally spaced from said roller circumference, said at least one working face being oblong and oriented along said one part cylinder, said clamping face, said locking face and said at least one working face being entirely made in one part, on remote length sides of said at least one working face said clamping bolts traversing said supporting body.

* * * * *